United States Patent [19]

O'Loughlin

[11] Patent Number: 4,621,421

[45] Date of Patent: Nov. 11, 1986

[54] METHOD OF MAKING AN ELECTRICAL TERMINAL

[75] Inventor: Francis A. O'Loughlin, Scotch Plains, N.J.

[73] Assignee: Thomas & Betts Corporation, Raritan, N.J.

[21] Appl. No.: 651,404

[22] Filed: Sep. 17, 1984

[51] Int. Cl.[4] ..... H01R 43/16

[52] U.S. Cl. ..... 29/874; 72/367

[58] Field of Search ..... 29/874, 885, 882; 72/367 X; 339/276 T, 224, 276 F

[56] References Cited

U.S. PATENT DOCUMENTS

| | | | |
|---|---|---|---|
| 860,889 | 7/1907 | Tower | 29/874 |
| 1,433,878 | 10/1922 | Fancher et al. | 72/367 |
| 1,433,890 | 10/1922 | Fancher et al. | 72/367 |
| 1,564,944 | 12/1925 | Colby | 339/276 T |
| 1,642,696 | 9/1927 | Rateike | 29/882 |
| 2,957,226 | 10/1960 | Dibner | 29/155.55 |
| 2,968,788 | 1/1961 | Neaderland et al. | 339/277 |
| 4,014,201 | 3/1977 | Troutner et al. | 72/367 X |
| 4,293,181 | 10/1981 | Lacaze, Jr. | 339/258 |
| 4,345,373 | 8/1982 | Lacaze, Jr. | 29/874 |

FOREIGN PATENT DOCUMENTS

| | | | |
|---|---|---|---|
| 1361928 | 7/1974 | United Kingdom | 29/874 |

*Primary Examiner*—Howard N. Goldberg
*Assistant Examiner*—Joseph M. Gorski
*Attorney, Agent, or Firm*—Robert M. Rodrick; Salvatore J. Abbruzzese

[57] ABSTRACT

A method of forming an electrical terminal is disclosed. A longitudinal extent of stock tubular material is provided. An end portion thereof is divided into two leg extents each having an unsupported extent extending from the tubular material. The legs are the formed into electrical terminal portions which accommodate thereinbetween a terminal post.

2 Claims, 10 Drawing Figures

FIG. 5
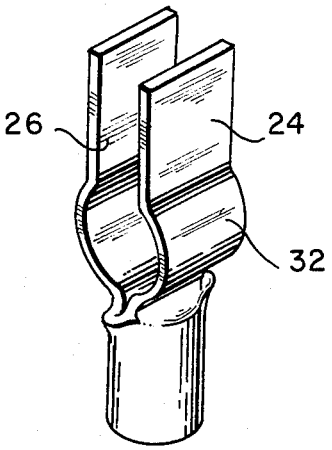
FIG. 6
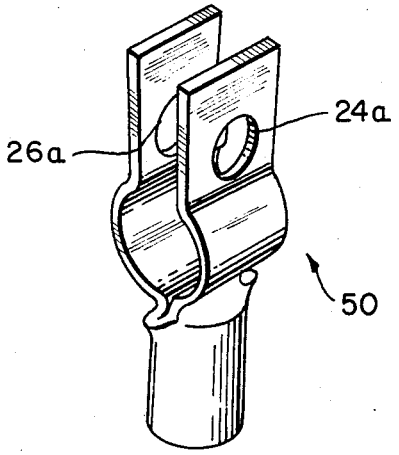
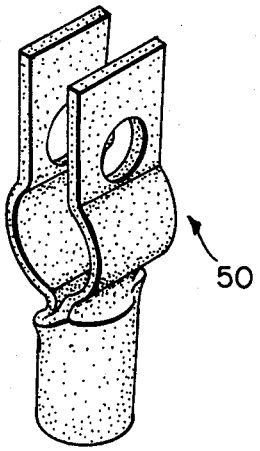
FIG. 7

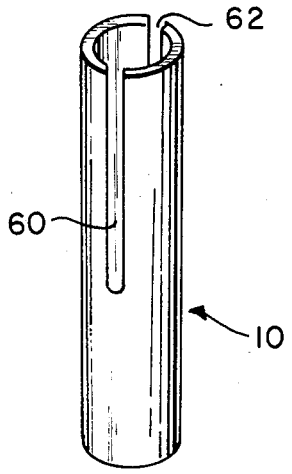
FIG. 8
FIG. 9
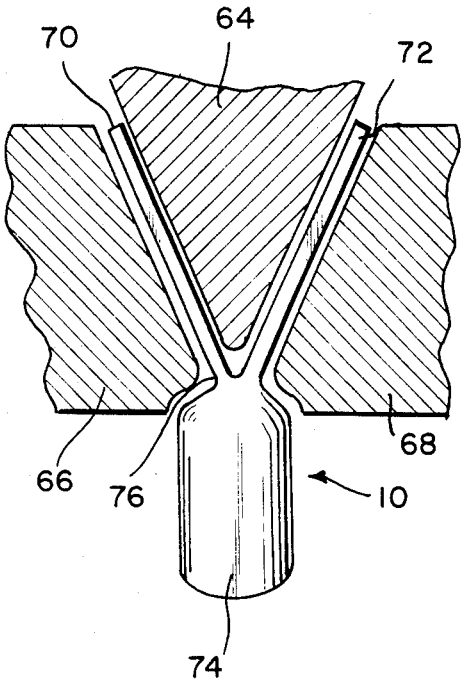
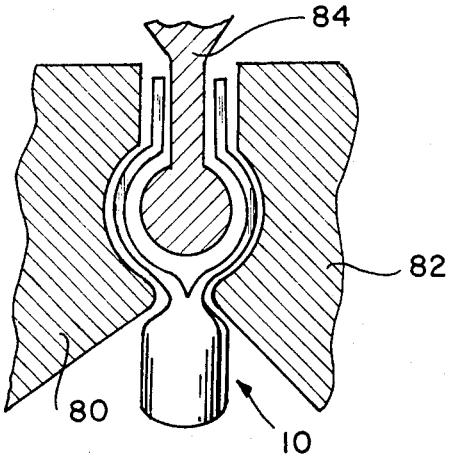
FIG. 10

METHOD OF MAKING AN ELECTRICAL TERMINAL

FIELD OF THE INVENTION

This invention relates generally to a method of making an electrical terminal and more particularly to a method of making an electrical terminal having a pair of upstanding terminal legs.

BACKGROUND OF THE INVENTION

Electrical terminals of the type described herein include a tubular end portion, commonly referred to as the barrel which is placed over the stripped end of an electrical cable. This barrel may be crimped or otherwise mechanically and electrically secured to the electrical cable. The other end of the terminal, the connection end is typically one of two types. The first type is a simple flattened end having an aperture therethrough and which can be placed over a terminal post or can accept a nut and bolt assembly for connection. Terminals of this type and methods for making such terminals are shown and described in U.S. Pat. Nos. 860,889 issued July 23, 1907; 2,957,226 issued Oct. 25, 1960 and 2,968,788 issued Jan. 17, 1961. The second type of terminals is a dual leg terminal having a barrel end for connection to an electrical cable as above-described and a pair of upstanding leg portions which accommodate therebetween a terminal post. This type of terminal is commonly found in many automobiles for connection to the battery. Each leg may include an opening at its distal extent through which a nut and bolt assembly can be used to secure the legs to the terminal post.

This second type terminal having a pair of upstanding legs, is more difficult to manufacture than the simple flattened end variety of the first type. Whereas the first type terminal can be made from stock tubing by flattening one end, the dual leg aspect of the second type terminal has heretofore prevented the use of such manufacturing expediency. Typically, dual leg terminals are made by casting methods where heated liquid metal is poured into a cast form. Alternatively, the dual leg terminal may be formed from a length of flat metal where the upstanding legs are blanked from the flat plate and the remaining portion is rolled forming the barrel.

It is apparent that each of the methods of forming the two leg terminals is more complicated, time consuming and expensive than is the method of using tubing to form the terminal of the first type. However, heretofore there has not been a satisfactory method of using tube stock to form a two leg terminal.

SUMMARY OF THE INVENTION

It is therefor an object of the present invention to provide a method of making an electrical terminal from a length of tubing.

It is a further object of the present invention to provide a method of forming a two-leg electrical terminal from such tubing.

In the efficient attainment of the foregoing and other objects, the invention looks toward a method of forming a length of stock tubing to have a barrel end for attachment to an electrical cable and an opposite terminal end having two spaced terminal legs extending from the barrel. The resulting terminal is integrally formed from a single length of stock tubing.

In a particular method described herein, the invention provides the steps of providing a selected length of tubular material. This length is divided at an end extent thereof into a pair of terminal legs supported at one end to a barrel portion of the tube. The legs are flattened and spread apart at their unsupported extents. The legs may then be formed into the appropriate shape to accommodate a battery post or the like.

BRIEF DESCRIPTION OF THE DRAWINGS

FIGS. 3–6 show the successive steps of the method of forming an electrical terminal in accordance with the present invention.

FIG. 7 shows the final formed terminal which is plated with a corrosion resistant coating.

FIGS. 8–10 show another method in accordance with the present invention of forming an electrical terminal.

DETAILED DESCRIPTION OF THE PREFERRED EMBODIMENT

Figure 1:
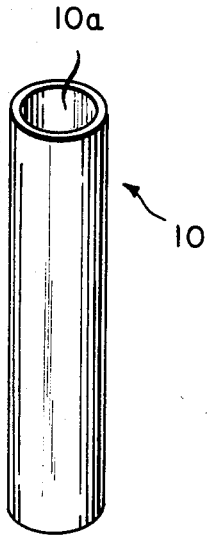
FIG. 1 shows a length of tubular metal used to form the terminal in accordance with the method of the present invention.

Referring to FIG. 1 of the drawings, in order to form an electrical terminal in accordance with the method of the present invention, a length of substantially cylindrical, hollow, metal tubing 10 is employed. Tubing 10 is a cut from a longer length of such metal tubing (not shown). The length of tubing 10 is appropriately selected for the size, i.e. wire gage of the cable (not shown) which is to be terminated. As the terminal is both mechanically and electrically crimped to a bared end of the cable, the metal selected is typically a high conductive, malleable metal such as copper.

Figure 2:
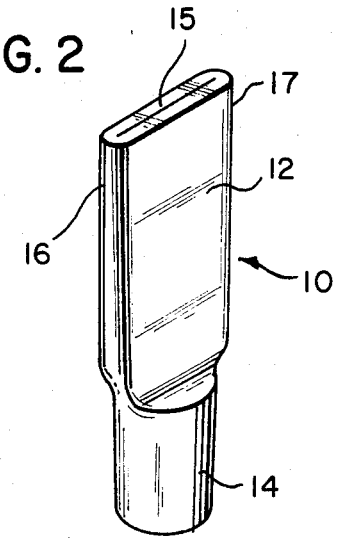
FIG. 2 shows the metal tube of FIG. 1 flattened at an end extent thereof.
Figure 3:
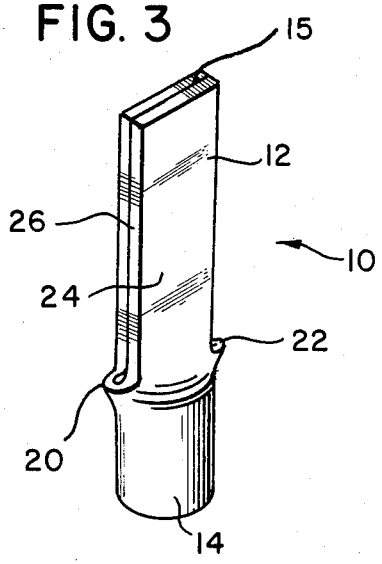

Now referring to FIG. 2, the tubing 10 is flattened at one end along a longitudinal extent 12 thereof. Flattened extent 12 extends for approximately 75% of the length of tubing 10. A cylindrical barrel portion 14 remains at the other end of tubing 10 after the flattening operation is completed. The flattening of tubing 10 occurs at a diametrical axis 15. The flattening causes the central bore 10*a* of the tubing 10 to collapse along axis 15 closing the bore 10*a* at the flattened extent 12. Thus the flattened extent 12 will have a thickness which is twice the wall thickness of the barrel portion 14. Elongate unitary portions 16 and 17, on opposite ends of axis 15 form the longitudinal edges of the flattened portion 12. In FIG. 3 the next step in the presently described method is shown. The elongate unitary portions 16 and 17 are trimmed or cut from the flattened portion 12 and are removed as scrap. The unitary portions 16 and 17 are trimmed down to the barrel portion 14 leaving a pair of oppositely directed protrusions 20 and 22. Once the unitary portions 16 and 17 (FIG. 2) are removed the flattened portion 12 comprises a pair of flat elongate legs 24 and 26 integrally attached at one end to barrel portion 14 and separated along axis 15.

Figure 4:
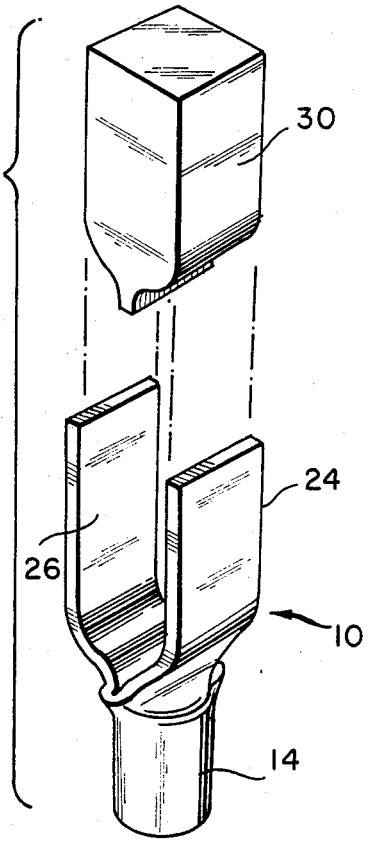

Referring to FIG. 4 the flat elongate legs 24 and 26 are then separated at the end opposite barrel portion 14. A forming die 30 is brought down between the two flattened legs 24 and 26 to spread them apart. The forming die is of a selected shape to impart such shape to the spread legs 24 and 26. In the present example, the die 30 has a rounded point 31 and such shape is imparted to the legs adjacent the barrel 14. Typically, the tube 10 will be held in retaining dies (not shown) on either side thereof. The retaining dies support the tube 10 for proper shaping by the forming die 30. The retaining dies may also be configured to impart a given configuration to legs 24 and 26. The retaining dies and the forming die 30 can be constructed to provide an arcuate mid-section 32 to legs 24 and 26 as shown in FIG. 5 and as further described hereinbelow with references to FIGS. 9 and 10. This type of configuration will more readily accommodate a terminal post (not shown), such as that conventionally used on most automobile batteries.

Further describing the present method, apertures 24*a* and 26*a* may be placed in legs 24 and 26 adjacent its distal unsupported extents. Apertures 24*a* and 26*a* are punched or otherwise conventionally placed in legs 24 and 26. These apertures accommodate a conventional nut and bolt assembly (not shown) or similar device to secure the terminal to the terminal post. The final step described herein is shown in FIG. 7 wherein the completed terminal 50 is dipped into a bath of lead zinc or other similar plating material to provide corrosion resistance.

While the foregoing description provides one method of producing an electrical terminal, similar techniques may also be employed. Further, the above steps need not be accomplished in the preferred order set forth above. For example, apertures 24*a* and 26*a* may be formed just after flattening the tube (FIGS. 2 or 3), thus upon spreading the legs 24 and 26, the apertures would be mutually aligned.

A further method of producing an electrical terminal in accordance with the present invention is shown in FIGS. 8–10.

The stock tubing 10 (FIG. 1) is split longitudinally along opposite diametrical portions thereof with slits 60 and 62. A forming die 64 is inserted into the slits 60 and 62 and the tube 10 is retained in a pair of retaining die halves 66 and 68. The tubing portion adjacent retaining die halves 66 and 68 are flattened into two terminal legs 70 and 72 which are integrally supported to a barrel portion 74 of tubing 10. The forming die 64 and retaining die halves 66 and 68 also neck the transition portion 76 between barrel portion 74 and legs 70 and 72.

The formed tubing is then placed in a second set of retaining die halves 80 and 82. A second forming die 84 is placed thereinbetween to impart a shape to tubing 10 such as shown in FIG. 5. As above described apertures may be appropriately made in the terminal legs adjacent arcuate mid-section 32 (FIG. 5) for facilitating connection to a battery post.

Various other modifications to the foregoing disclosed embodiment will be evident to those skilled in the art. Thus, the particularly described preferred embodiment is intended to be illustrative and not limited thereto. The true scope of the invention is set forth in the following claims.

I claim:

1. A method of making an electrical terminal for attachment to a terminal post, comprising the steps of:

providing a selected length of tubular material;

dividing an end extent of said tubular material into two legs, each of said legs having an unsupported extent at one end thereof and being individually supported from a barrel portion of said tubualr material at an end opposite said one end;

spreading said legs;

flattening said legs; and inserting a forming die between said legs thereby providing an arcuate portion in each of said legs complementary to said terminal post.

2. A method in accordance with claim 1 further comprising the step of:

punching an aperture in each leg adjacent said arcuate portion.

* * * * *